US009016834B2

(12) United States Patent
Mita

(10) Patent No.: US 9,016,834 B2
(45) Date of Patent: Apr. 28, 2015

(54) LIQUID EJECTION HEAD, METHOD OF MANUFACTURING LIQUID EJECTION HEAD AND IMAGE FORMING APPARATUS

(75) Inventor: Tsuyoshi Mita, Ashigarakami-gun (JP)

(73) Assignee: FUJIFILM Corporation (JP)

( * ) Notice: Subject to any disclaimer, the term of this patent is extended or adjusted under 35 U.S.C. 154(b) by 1450 days.

(21) Appl. No.: 12/721,347

(22) Filed: Mar. 10, 2010

(65) Prior Publication Data

US 2010/0231650 A1 Sep. 16, 2010

(30) Foreign Application Priority Data

Mar. 12, 2009 (JP) ..... 2009-059946

(51) Int. Cl.

| | |
|---|---|
| ***B41J 2/14*** | (2006.01) |
| ***B41J 2/045*** | (2006.01) |
| ***B41J 2/16*** | (2006.01) |

(52) U.S. Cl.

CPC ..... *B41J 2/14201* (2013.01); *B41J 2/1607* (2013.01); *B41J 2/1628* (2013.01); *B41J 2/1629* (2013.01); *B41J 2/1631* (2013.01)

(58) Field of Classification Search

None

See application file for complete search history.

(56) References Cited

U.S. PATENT DOCUMENTS

| | | | | |
|---|---|---|---|---|
| 5,202,703 | A | 4/1993 | Hoisington et al. | |
| 7,084,555 | B2 | 8/2006 | Bachellerie et al. | |
| 2001/0007462 | A1 * | 7/2001 | Jeong et al. | 347/72 |
| 2004/0070650 | A1 | 4/2004 | Sugahara | |
| 2004/0112635 | A1 | 6/2004 | Sasaki et al. | |
| 2006/0087536 | A1 | 4/2006 | Sugahara | |

FOREIGN PATENT DOCUMENTS

| | | |
|---|---|---|
| JP | 2003008091 | 10/2003 |
| JP | 2004-136461 | 5/2004 |
| JP | 2004-207693 | 7/2004 |
| JP | 2006-150948 A | 6/2006 |
| JP | 2008-254202 | 10/2008 |
| WO | 92/08617 | 5/1992 |

OTHER PUBLICATIONS

Office action mailed Oct. 22, 2012 in corresponding Japanese application No. 2009-059946, 10 pgs.

Nakamura et al., "Trapped-Energy Piezoelectric Resonators with Elliptical Ring Electrodes." 44th Annual Symposium on Frequency Control, Tohoku University, Sendai, Japan, 6 pages.

Office action issued Aug. 29, 2013 in corresponding Japanese Application No. 2009-059946, 7 pgs.

* cited by examiner

*Primary Examiner* — Geoffrey Mruk

(74) *Attorney, Agent, or Firm* — Fish & Richardson P.C.

(57) ABSTRACT

A liquid ejection head includes: a flow channel unit having a plurality of pressure chambers arranged in a plane; and piezoelectric actuators which change volume of the plurality of pressure chambers so as to apply pressure to liquid inside the plurality of the pressure chambers respectively, wherein the piezoelectric actuators comprise: a diaphragm which constitutes one wall of the plurality of pressure chambers; a common electrode formed on a surface of the diaphragm; a piezoelectric layer formed on a surface of the common electrode; a plurality of ring-shaped individual electrodes formed on a surface of the piezoelectric layer and formed in regions which overlap respectively with marginal portions which are non-central portions of the plurality of pressure chambers, as viewed from a direction perpendicular to the plane; and central electrodes connected electrically to the common electrode, and formed so as not to make contact with the plurality of ring-shaped individual electrodes in inner regions of the plurality of ring-shaped individual electrodes, as viewed from the direction perpendicular to the plane.

18 Claims, 11 Drawing Sheets

LIQUID EJECTION HEAD, METHOD OF MANUFACTURING LIQUID EJECTION HEAD AND IMAGE FORMING APPARATUS

BACKGROUND OF THE INVENTION

1. Field of the Invention

The present invention relates to a liquid ejection head, a method of manufacturing a liquid ejection head, and an image forming apparatus, and more particularly to a liquid ejection head in which a piezoelectric layer is provided between two electrode film layers, a method of manufacturing the liquid ejection head and an image forming apparatus equipped with the liquid ejection head.

2. Description of the Related Art

Japanese Patent Application Publication No. 2006-150948 (for example, paragraphs [0010], [0028] and [0038]) discloses a piezoelectric actuator comprising an individual electrode formed so as to surround the central portion of a pressure chamber, in a region which overlaps with the marginal portion of the pressure chamber apart from the central portion when observed in plan view. Moreover, Japanese Patent Application Publication No. 2006-150948 also describes increasing the amount of displacement of a diaphragm by using a ring-shaped individual electrode and adopting a structure in which a piezoelectric layer is not provided in the region which overlaps with the central portion of the pressure chamber.

International publication No. WO 92/08617 discloses that a single continuous electrode is arranged on a first surface of a plate-shaped piezoelectric converter segment, and first and second electrode rows arranged alternately and spaced apart in a mutually interlocking fashion are arranged on a second surface, the continuous electrode and the first electrodes being connected to a ground potential and the second electrode being connected to a positive potential.

In recent years, increase in the density of nozzles in a liquid ejection head has been progressing and there have been demands to achieve increased density of the nozzle arrangement (reduction in the surface area of piezoelectric actuators) at the same time as increasing the amount of displacement of the diaphragm by the piezoelectric actuators.

However, if the piezoelectric layer which covers the diaphragm is cut away completely as in Japanese Patent Application Publication No. 2006-150948, although the amount of displacement of the piezoelectric actuator can be increased, the rigidity of the diaphragm is diminished. If the rigidity of the diaphragm is low, then it becomes difficult, for example, to eject liquid of high viscosity and therefore piezoelectric actuators having a larger amount of displacement and greater rigidity are sought.

International publication No. WO 92/08617 aims to increase the amount of displacement by means of an elongating deformation effect between electrodes of different potential, but since the electrode shape is complex, it is difficult to lay out connections for the plurality of wires. Therefore, in the composition described in International publication No. WO 92/08617, it is difficult to create piezoelectric actuators having high density.

SUMMARY OF THE INVENTION

The present invention has been contrived in view of these circumstances, an object thereof being to provide a liquid ejection head whereby the rigidity of the diaphragm of a piezoelectric actuator can be improved and the amount of displacement of the diaphragm can be increased, and a method of manufacturing the liquid ejection head and an image forming apparatus comprising the liquid ejection head.

In order to attain an object described above, one aspect of the invention relates to a liquid ejection head, comprising: a flow channel unit having a plurality of pressure chambers arranged in a plane; and piezoelectric actuators which change volume of the plurality of pressure chambers so as to apply pressure to liquid inside the plurality of the pressure chambers respectively, wherein the piezoelectric actuators comprise: a diaphragm which constitutes one wall of the plurality of pressure chambers; a common electrode formed on a surface of the diaphragm; a piezoelectric layer formed on a surface of the common electrode; a plurality of ring-shaped individual electrodes formed on a surface of the piezoelectric layer and formed in regions which overlap respectively with marginal portions which are non-central portions of the plurality of pressure chambers, as viewed from a direction perpendicular to the plane; and central electrodes connected electrically to the common electrode, and formed so as not to make contact with the plurality of ring-shaped individual electrodes in inner regions of the plurality of ring-shaped individual electrodes, as viewed from the direction perpendicular to the plane.

According to this aspect, it is possible to increase the rigidity of the diaphragm by providing central electrodes. Furthermore, according to the first mode, since displacement occurs in the piezoelectric layer between the individual electrodes and the central electrodes, then it is possible to increase the amount of flexing displacement of the diaphragm. Consequently, according to the first mode described above, it is possible to ensure the rigidity of the diaphragm in the central portions of the pressure chambers, at the same time as increasing the amount of displacement.

Desirably, the piezoelectric layer has holes having a smaller planar dimension than the central electrodes and being formed in regions on the surface of the piezoelectric layer which overlap with central portions of the plurality of pressure chambers; and the central electrodes and the common electrode are connected electrically via a metal film formed inside the holes.

According to this aspect, a potential difference does not occur between the common electrode and the central electrodes, and therefore it is possible to constrict the distortion occurring in the portions of the piezoelectric layer which overlap with the central electrodes (central portions). Consequently, it is possible to increase the rigidity of the diaphragm. Therefore according to the second mode described above, it is possible to ensure the rigidity of the diaphragm in the central portions of the pressure chambers, at the same time as increasing the amount of displacement.

Desirably, the piezoelectric layer has holes having a substantially equal planar dimension to the central electrodes and being formed in regions which overlap with central portions of the plurality of pressure chambers; and the central electrodes are formed on a surface of the common electrode which is exposed on a surface side of the piezoelectric layer via the holes.

According to this aspect, by increasing the thickness of the central electrodes, it is possible to raise the intensity of the electric field generated between the central electrodes and the individual electrodes, and the amount of displacement of the diaphragm can increased yet further. Furthermore, the rigidity of the diaphragm can be increased by raising the thickness of the central electrodes and unifying the central electrodes and the common electrode.

Desirably, the piezoelectric layer has holes having a smaller planar dimension than the central electrodes and being formed in regions which overlap with central portions of the plurality of pressure chambers; the piezoelectric layer has recess sections having a substantially equal planar dimension to the central electrodes and being formed in regions which overlap with central portions of the plurality of pressure chambers, on the surface of the piezoelectric layer, at positions which overlap with the holes; the central electrodes are formed in the recess sections; and the central electrodes and the common electrode are connected electrically via a metal film formed inside the holes.

According to this aspect, by increasing the thickness of the central electrodes, it is possible to raise the intensity of the electric field generated between the central electrodes and the individual electrodes, and the amount of displacement of the diaphragm can increased yet further. Furthermore, by constricting the piezoelectric layer between the central electrodes and the common electrode, as well as increasing the thickness of the central electrodes, it is possible to increase the rigidity of the diaphragm.

Desirably, the holes in the piezoelectric layer are formed in centers of inner circumferential portions of the plurality of ring-shaped individual electrodes.

According to this aspect, it is possible to increase the rigidity of the piezoelectric layer on the diaphragm in the center of the pressure chambers.

Desirably, each of distances between the ring-shaped individual electrode and the central electrodes is equal to or greater than a thickness of the piezoelectric layer.

According to this aspect, shorting between the central electrodes and the individual electrodes can be prevented, and the reliability of the piezoelectric actuators can be improved.

Desirably, the plurality of ring-shaped individual electrodes have an inner circumferential shape that is substantially similar to a planar shape of the central electrodes.

Desirably, centers of inner circumferential portions of the plurality of ring-shaped individual electrodes and centers of the central electrodes coincide with each other when observed from the direction perpendicular to the plane.

According to these aspects, it is possible to cause an electric field to act in a substantially uniform manner on the region of the piezoelectric layer on the side of the central portions of the pressure chambers.

Desirably, the inner circumferential shape of the plurality of ring-shaped individual electrodes is substantially similar to a planar shape of the plurality of pressure chambers.

Desirably, centers of the plurality of ring-shaped individual electrodes and centers of the plurality of pressure chambers coincide with each other when observed from the direction perpendicular to the plane.

According to these aspects, it is possible to apply pressure in a substantially uniform manner to the pressure chambers, by means of the diaphragm.

Desirably, the plurality of ring-shaped individual electrodes extend up to regions which overlap with partitions of the plurality of pressure chambers.

According to this aspect, it is possible to increase the surface area of the active part of the piezoelectric layer which is displaced by the electric field produced between the individual electrode and the common electrode, and the amount of displacement of the diaphragm can be increased.

Desirably, the plurality of ring-shaped individual electrodes each have an inner circumference portion in a shape of an oval, and a cross-sectional shape of each of the central electrodes is a square shape.

Desirably, the plurality of ring-shaped individual electrodes each have an inner circumference portion in a shape of an oval, and a cross-sectional shape of each of the central electrodes is an octagon shape.

Desirably, the plurality of ring-shaped individual electrodes each have an inner circumference portion in a shape of an oval, and a cross-sectional shape of each of the central electrodes is an oval shape.

Desirably, the plurality of ring-shaped individual electrodes each have an inner circumference portion in a shape of a square, and a cross-sectional shape of each of the central electrodes is an oval shape.

Desirably, the plurality of ring-shaped individual electrodes each have an inner circumference portion in a shape of a square, and a cross-sectional shape of each of the central electrodes is an octagon shape.

Desirably, the plurality of ring-shaped individual electrodes each have an inner circumference portion in a shape of a square, and a cross-sectional shape of each of the central electrodes is an square shape.

Another mode of the invention relates to an image forming apparatus comprising the liquid ejection head as defined in above, wherein the plurality of ring-shaped individual electrodes are arranged on the surface of the piezoelectric layer, on an opposite side to the diaphragm; the common electrode is earthed; and the piezoelectric layer is polarized in a direction from the diaphragm toward the individual electrodes, the image forming apparatus further comprises a voltage application device which applies drive voltage waveform signals of negative potential to the individual electrodes so as to cause an electric field to act on the piezoelectric layer in a same direction as the direction of polarization of the piezoelectric layer, only when performing an ink ejection operation.

According to this mode, a drive voltage is applied to the individual electrodes only when carrying out an ink ejection operation, and therefore an electric field is not applied to the piezoelectric layer under normal circumstances. Therefore, it is possible to prevent deterioration of the piezoelectric layer and the reliability of the liquid ejection head can be further increased.

Another mode of the invention relates to a method of manufacturing a liquid ejection head, the method comprising the steps of: forming a common electrode on a surface of a diaphragm which constitutes one wall of a plurality of pressure chambers in a flow channel unit having the plurality of the pressure chambers which are arranged in a plane; forming a piezoelectric layer on a surface of the common electrode; forming a plurality of ring-shaped individual electrodes in regions on a surface of the piezoelectric layer which overlap respectively with marginal portions which are non-central portions of the plurality of pressure chambers, as viewed from a direction perpendicular to the plane; and (d) forming central electrodes connected electrically to the common electrode so as not to make contact with the plurality of ring-shaped individual electrodes in inner regions of the plurality of ring-shaped individual electrodes, as viewed from the direction perpendicular to the plane.

Desirably, the step (d) comprises the steps of: forming holes having a smaller planar dimension than the central electrodes in regions on the surface of the piezoelectric layer which overlap with central portions of the plurality of pressure chambers; forming a metal film inside the holes and the surface of the piezoelectric layer; and forming the central electrodes which are connected electrically with the common electrode via the metal film formed in the holes.

Desirably, the step (d) comprises the steps of: forming holes of substantially a same planar dimension as the central electrodes in regions on the surface of the piezoelectric layer which overlap with central portions of the plurality of pressure chambers; and forming the central electrodes on the surface of the common electrode which is exposed on a surface side of the piezoelectric layer via the holes.

Desirably, the step (d) comprises the steps of: forming holes having a smaller planar dimension than the central electrodes in regions on the surface of the piezoelectric layer which overlap with central portions of the plurality of pressure chambers; forming recess sections having a substantially equal planar dimension to the central electrodes in regions which overlap with the central portions of the plurality of pressure chambers, on the surface of the piezoelectric layer, at positions which overlap with the holes; and forming a metal film inside the hole and the recess sections, and forming, in the recess section, the central electrodes which are connected electrically to the common electrode via the metal film formed inside the holes.

According to the present invention, a potential difference does not occur between the common electrode and the central electrodes, and therefore it is possible to constrict the distortion occurring in the portions of the piezoelectric layer which overlap with the central electrodes (central portions). Consequently, it is possible to increase the rigidity of the diaphragm. Furthermore, according to the present invention, since displacement occurs in the piezoelectric layer between the individual electrodes and the central electrodes, then it is possible to increase the amount of flexing displacement of the diaphragm. Consequently, according to the present invention, it is possible to ensure the rigidity of the diaphragm in the central portion of the pressure chambers, at the same time as increasing the amount of displacement.

Figure 4:
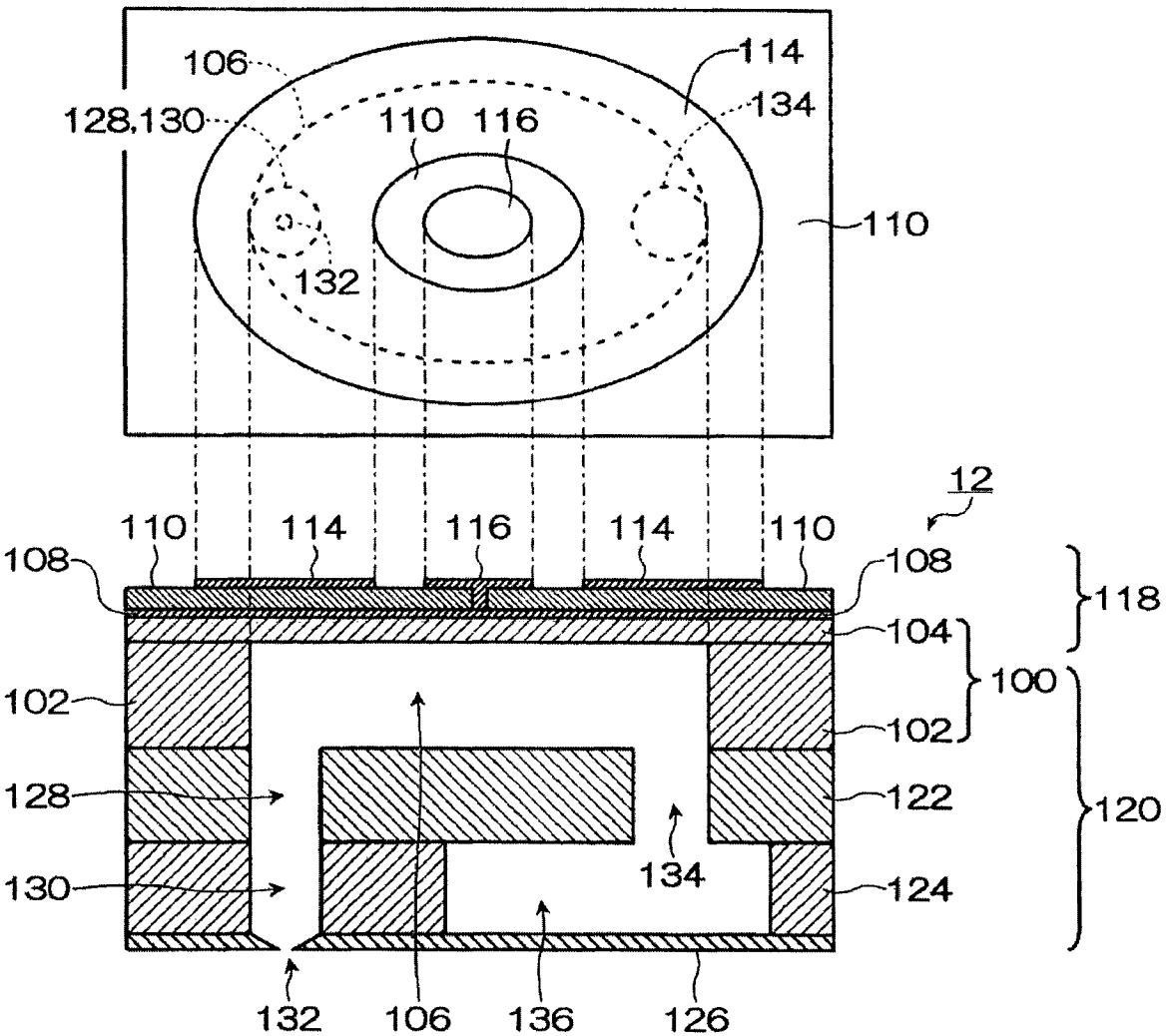
Figure 5:
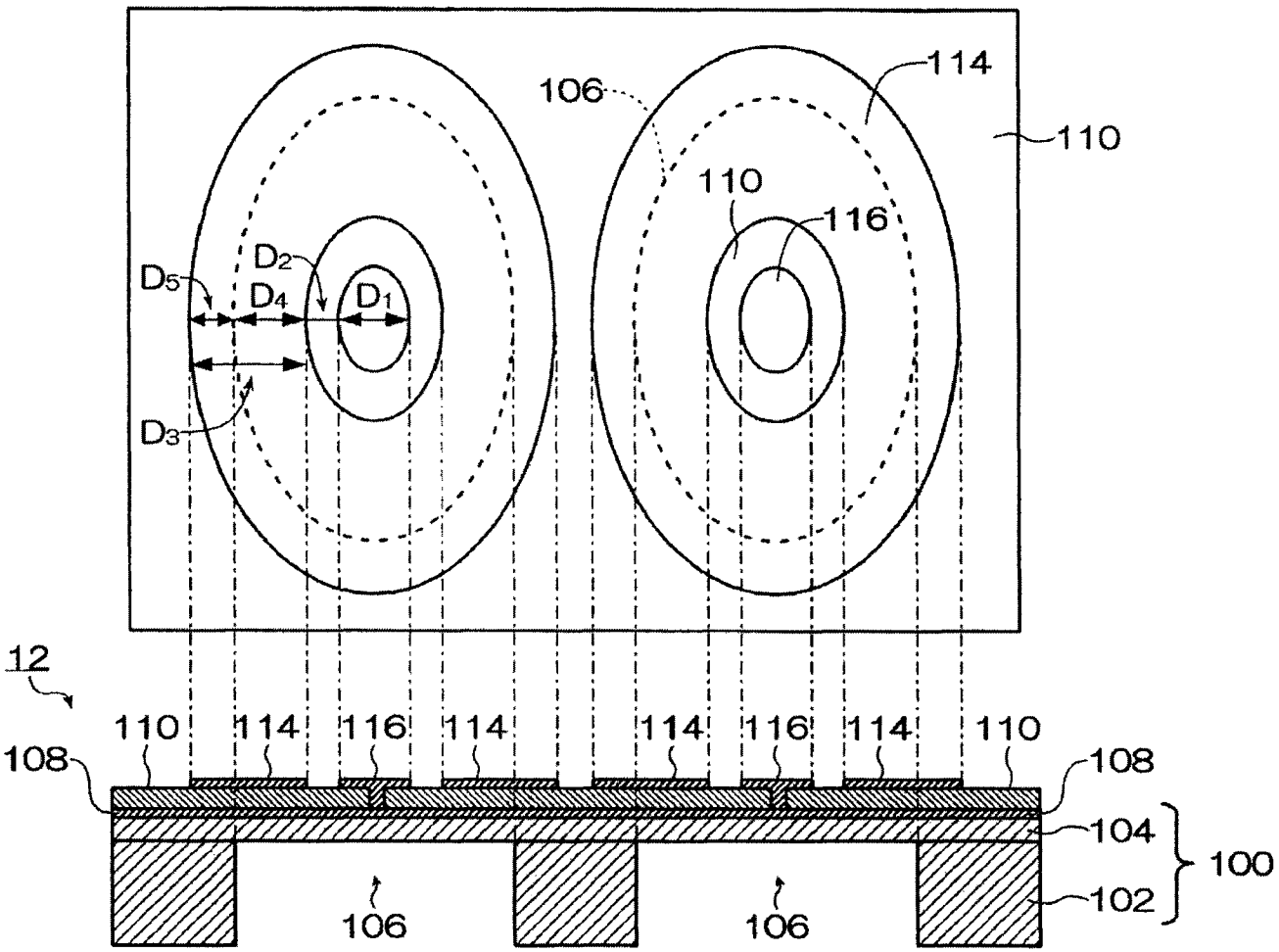
Figure 6A:
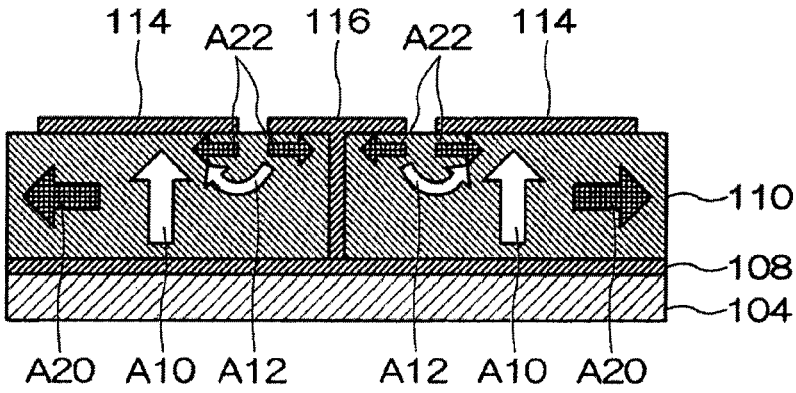
Figure 6B:
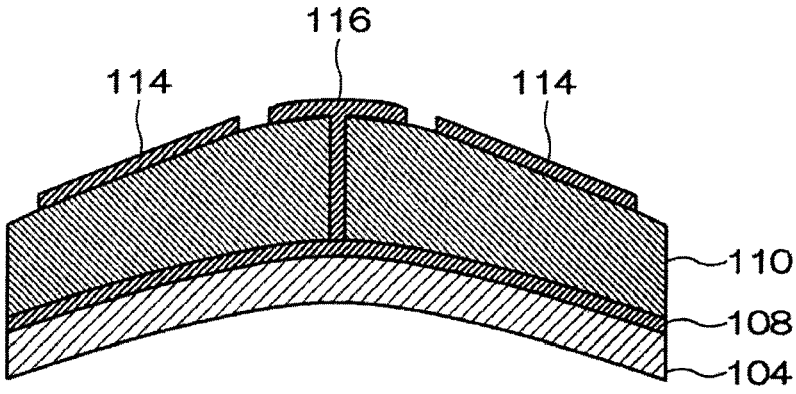
Figure 10A:
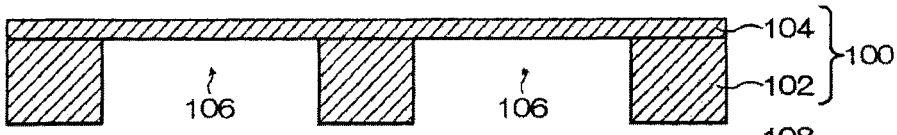
Figure 10B:
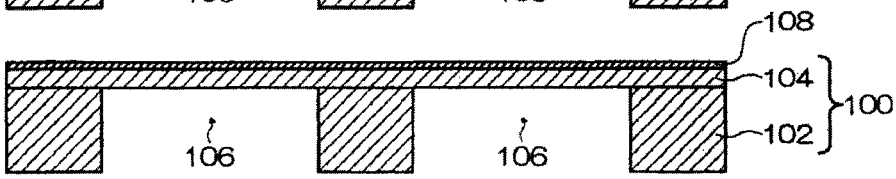
Figure 10C:
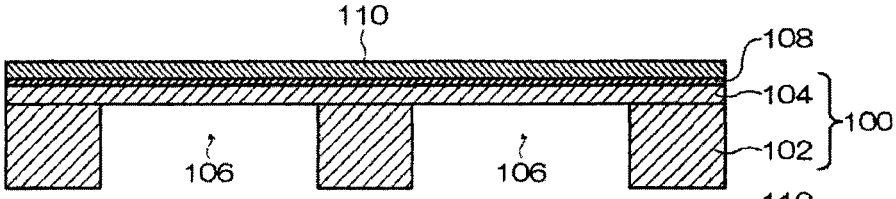
Figure 10D:
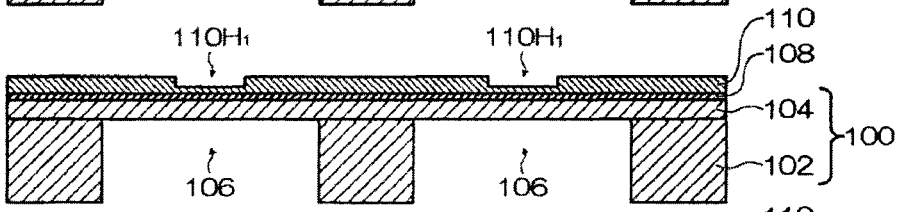
Figure 10E:
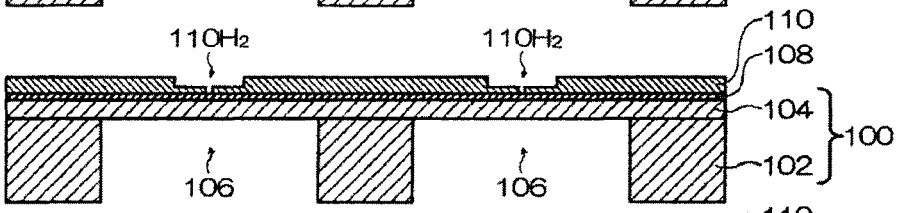
Figure 10F:
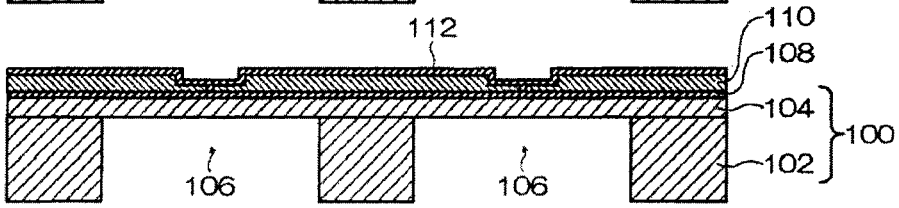
Figure 10G:
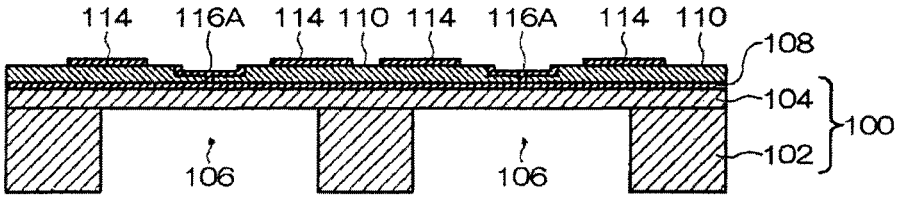
Figure 10H:
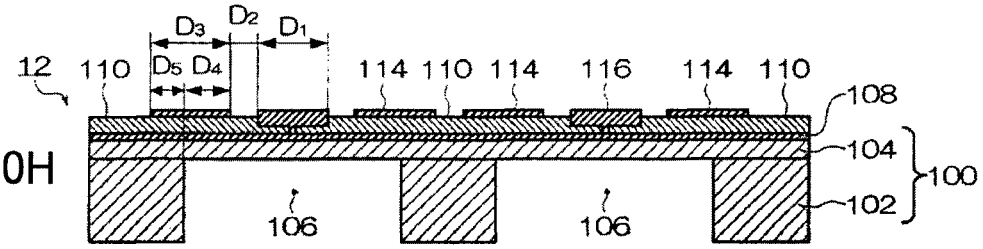
Figure 11:
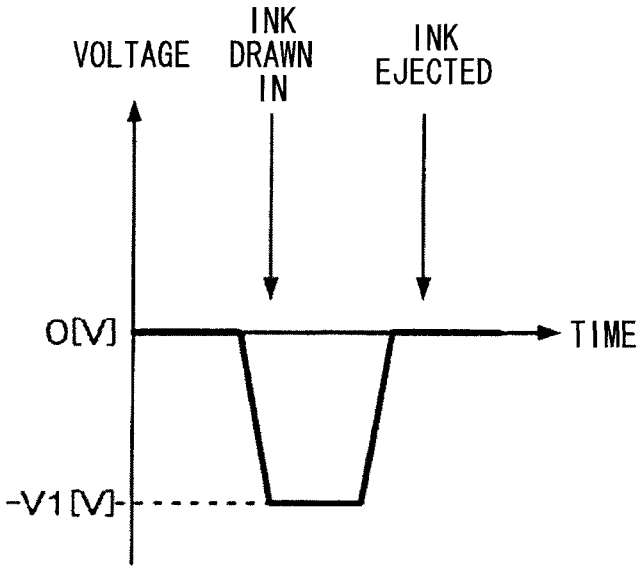

(a) and (b) of FIG. 4 are diagrams showing a liquid ejection head according to a first embodiment of the present invention;

(a) and (b) of FIG. 5 are diagrams showing a liquid ejection head according to a first embodiment of the present invention;

FIGS. 6A and 6B are cross-sectional diagrams showing a schematic view of the state of displacement of the piezoelectric layer 110;

FIGS. 7A to 7F are plan diagrams showing an example of the planar shape of the central electrode 116;

FIGS. 8A to 8F are cross-sectional diagrams showing a method of manufacturing a liquid ejection head according to a first embodiment of the present invention;

FIGS. 9A to 9G are cross-sectional diagrams showing a method of manufacturing a liquid ejection head according to a second embodiment of the present invention;

FIGS. 10A to 10H are cross-sectional diagrams showing a method of manufacturing a liquid ejection head according to a third embodiment of the present invention; and FIG. 11 is a graph showing a drive voltage waveform when driving a liquid ejection head relating to the present invention.

DETAILED DESCRIPTION OF THE PREFERRED EMBODIMENTS

Composition of Image Forming Apparatus

Figure 1:
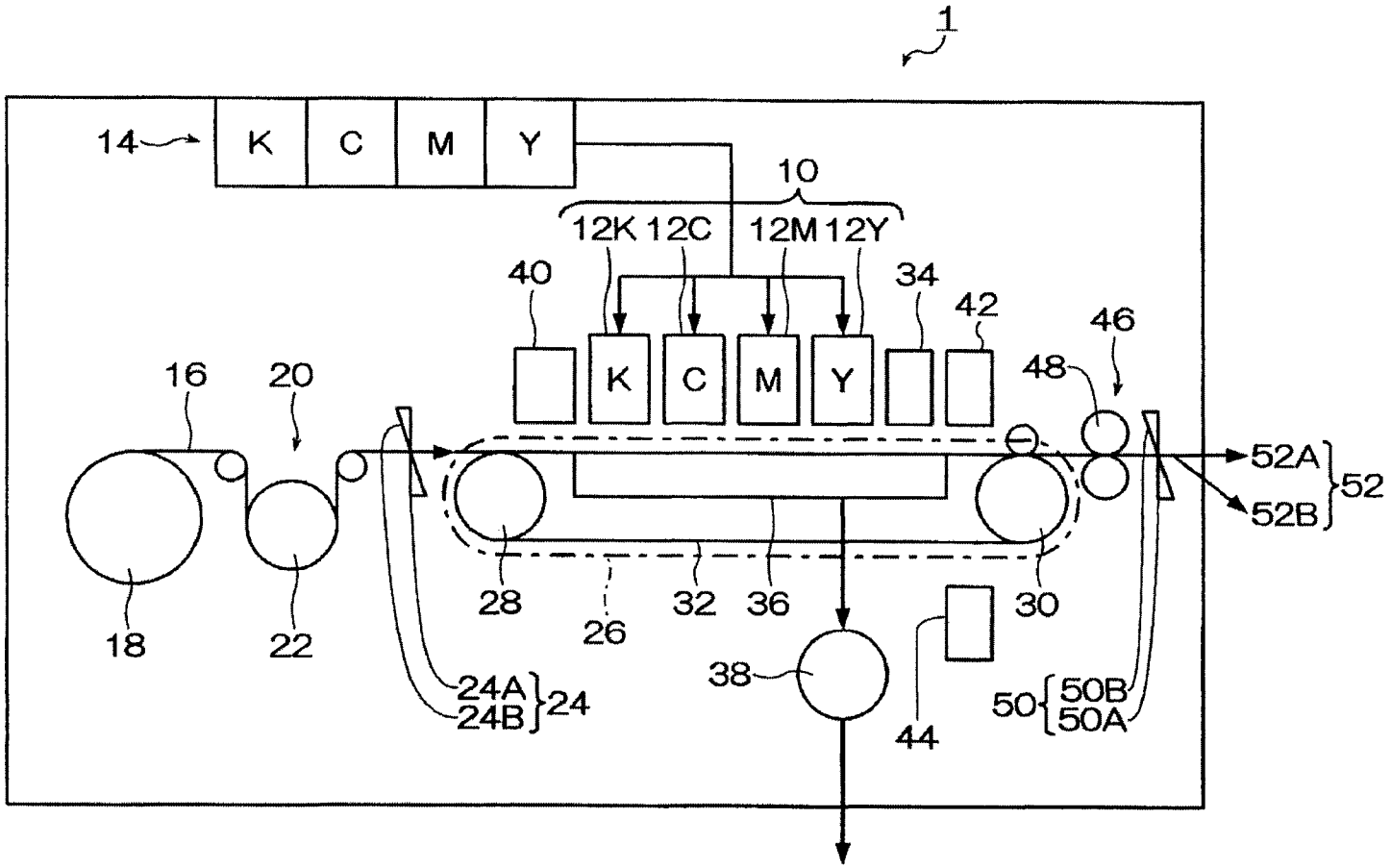
FIG. 1 is a schematic drawing of an inkjet recording apparatus relating to one embodiment of the present invention.

Firstly, the composition of an image forming apparatus (inkjet recording apparatus) comprising a liquid ejection head relating to an embodiment of the present invention will be described with reference to FIG. 1. FIG. 1 is a diagram showing a schematic view of an inkjet recording apparatus relating to one embodiment of the present invention, and FIG. 2 is a plan diagram showing the periphery of the print unit of the inkjet recording apparatus.

Figure 3:
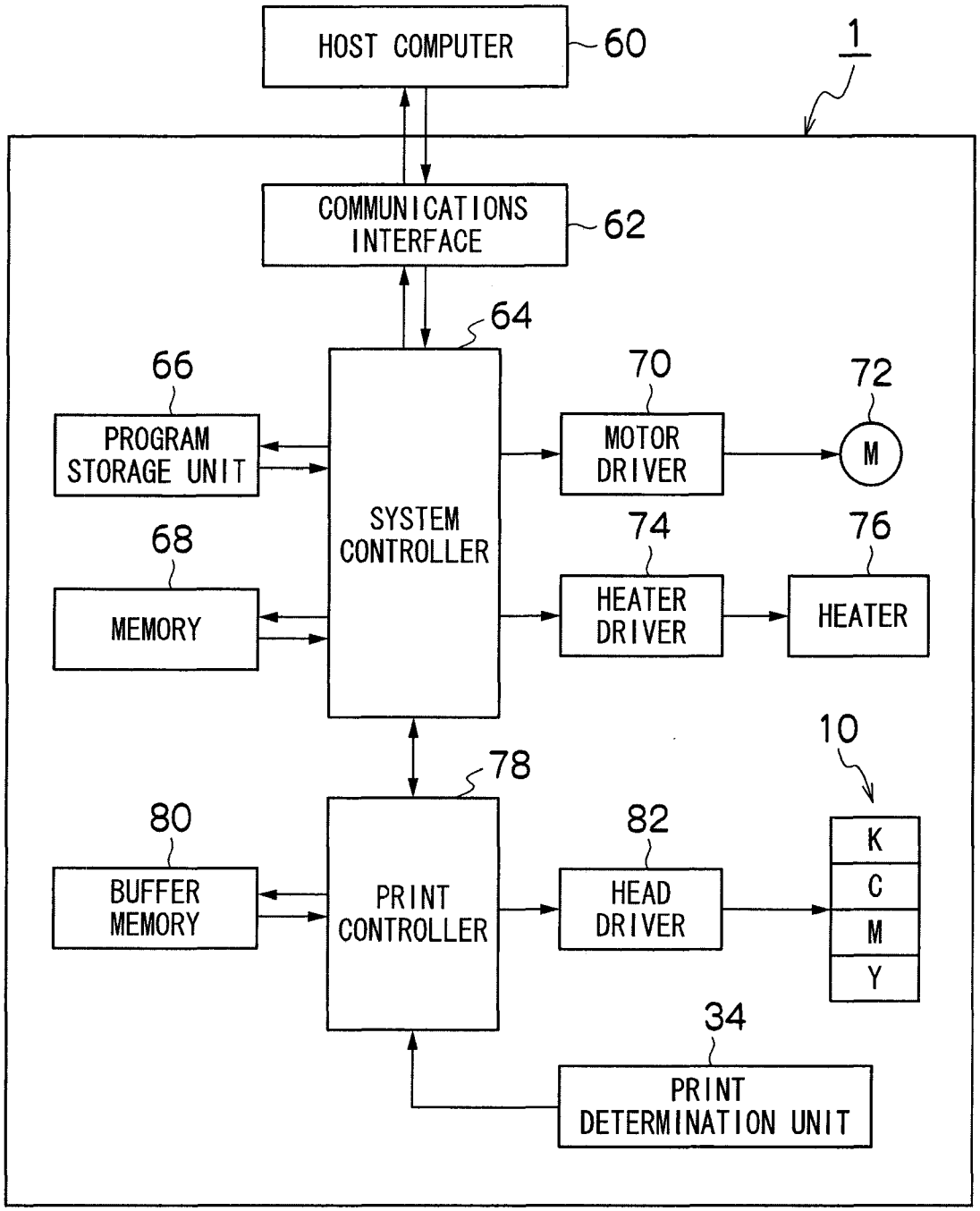
FIG. 3 is a block diagram showing the control system of an inkjet recording apparatus.

As shown in FIG. 1, the inkjet recording apparatus 1 relating to the present embodiment comprises a print unit 10 having liquid ejection heads 12K, 12C, 12M and 12Y which respectively eject inks of the four colors of black (K), cyan (C), magenta (M) and yellow (Y), and forms a color image by ejecting inks of the four colors onto the printing surface of recording paper 16 from the print unit 10, on the basis of image data input from a host computer (reference numeral 60 in FIG. 3).

Figure 2:
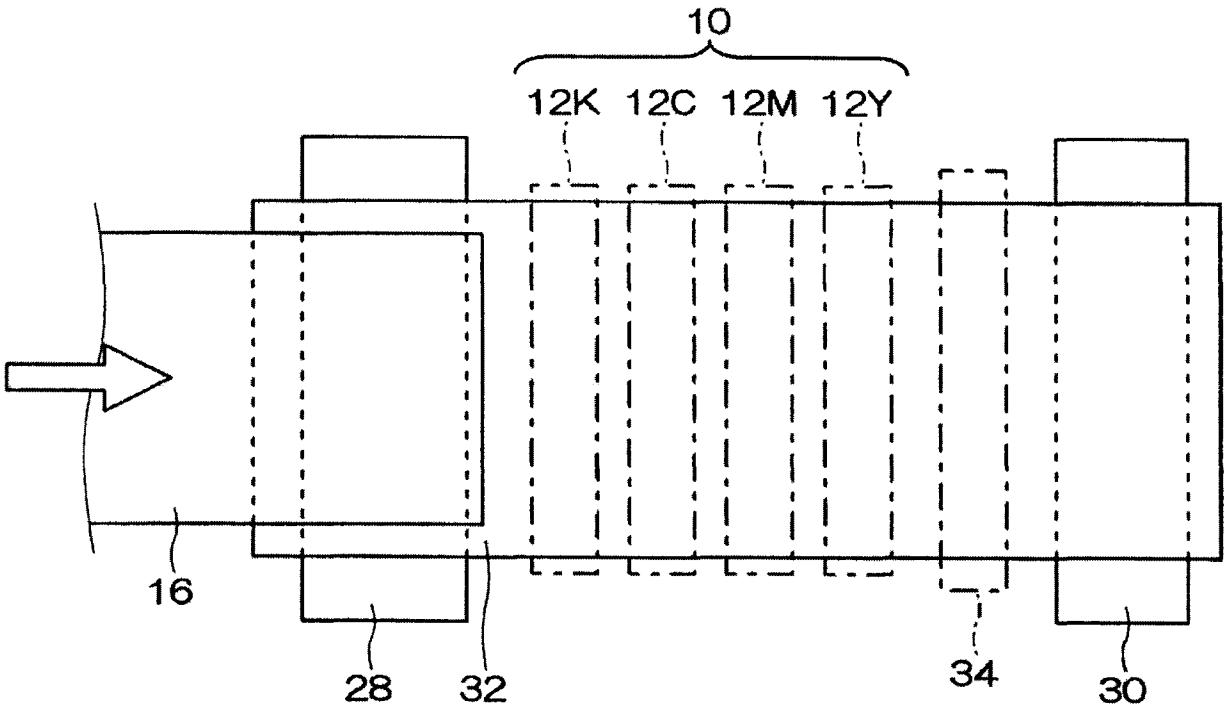
FIG. 2 is a plan diagram showing the main composition of the peripheral area of a print unit of an inkjet recording apparatus.

As shown in FIG. 2, the print unit 10 is a so-called full line type of head in which line type liquid ejection heads 12K, 12C, 12M and 12Y having a length corresponding to the maximum paper width of the recording paper 16 are arranged in a direction (main scanning direction) which is perpendicular to the paper conveyance direction (sub-scanning direction).

The ink storing and loading unit 14 stores inks of the respective colors of K, C, M and Y. The inks stored in the ink storing and loading unit 14 are supplied to the liquid ejection heads 12 via ink supply channels.

The ink colors and the number of colors are not limited to the standard (four) colors of K, C, M and Y described above, and it is also possible to add liquid ejection heads which eject light inks or dark inks, for example. For instance, it is possible to add liquid ejection heads which eject light inks, such as light cyan, light magenta, or the like.

The paper supply unit 18 supplies recording paper 16 to the print unit 10. The paper supply unit comprises a magazine for rolled paper (continuous paper). A plurality of magazines for different paper widths and different paper qualities, and the like, may be provided. Furthermore, it is also possible to provide a cassette in which cut paper is stacked.

The decurling unit 20 removes the traces of winding (curl) in the recording paper 16, by heating the recording paper 16 which is sent out from the paper supply unit 18, by means of a heating drum 22. During decurling, it is desirable to control the heating temperature and to apply a slight outward curl to the printed surface.

The cutter 24 comprises a fixed blade 24A which is disposed on the rear surface side of the print surface of the recording paper 16 and a circular blade 24B which is disposed on the print surface side. The recording paper 16 sent out from the paper supply unit 18 is cut to a desired size by a cutter 24. Decurling is carried out by the decurling unit 20 and the cut recording paper 16 is then supplied to the suction belt conveyance unit 26.

The suction belt conveyance unit 26 comprises two rollers 28 and 30, and an endless belt 32 which is wound between the rollers 28 and 30. Drive force from a motor is transmitted to at least one of the rollers 28 and 30, thereby driving the belt 32 in the clockwise direction in FIG. 1. By this means, the recording paper 16 held on the surface of the belt 32 is conveyed from left to right in FIG. 1.

The rollers 28 and 30 and the belt 32 are disposed in such a manner that the portion facing the nozzle surfaces of the liquid ejection heads 12K, 12C, 12M and 12Y of the print unit 10 and the sensor surface of the print determination unit 34 is flat.

The width of the belt 32 is greater than the width of the recording paper 16 (see FIG. 2). A plurality of suction holes (not illustrated) are formed in the surface of the belt 32. A suction chamber 36 is provided at a position opposing the nozzle surface of the print unit 10 on the inner side of the belt 32 and the sensor surface of the print determination unit 34. The suction chamber 36 is set to a negative pressure by a fan 38. Thereby, the recording paper 16 is suctioned and held on the surface of the belt 32.

The heating unit 40 heats the recording paper 16 before printing, in order to shorten the time period from depositing ink onto the recording paper 16 until drying of the ink. A heating fan which applies heat by blowing heated air onto the recording paper 16, for example, is used as the heating unit 40.

The print determination unit 34 comprises an image sensor for capturing an image of the ink droplet ejection results of the print unit 10. As shown in FIG. 2, the print determination unit 34 is constituted by a line sensor having rows of photoreceptor elements with a width that is greater than the ink droplet ejection width (image recording width) of the print heads 12K, 12C, 12M and 12Y. It is possible to use area sensors, for example, as the print determination unit 34.

The post drying unit 42 is an apparatus which dries the print surface of the recording paper 16. A heating fan, for example, is used as the post drying unit 42.

The belt cleaning unit 44 removes ink which has adhered to the belt 32. As a method for cleaning the belt 32, it is possible to use, for example, a method which nips a brush roller and water absorbing roll, or the like, or an air blowing method which blows a cleaning air flow.

The heating and pressurizing unit 46 is an apparatus for controlling the glossiness of the surface of the image printed on the recording paper 16. The heating and pressurizing unit 46 is disposed after the post drying unit 42 and applies pressure to the printed surface by means of a pressurization roller 48 having a prescribed undulating surface form, while applying heat, thereby transferring the undulating form to the image surface.

As described above, the recording paper 16 (printed item) on which an image has been printed is output from the paper output unit 52. The inkjet recording apparatus 1 relating to the present embodiment comprises a sorting device (not illustrated) which switches the paper output path in order to sort a printed item on which an image intended for printing has been printed, and a printed item on which a test pattern for print result determination has been printed, and guide these to respective paper output units 52A and 52B.

If the main image and the test print are formed simultaneously in a parallel fashion, on the recording paper 16, then the portion corresponding to the test print is cut off by means of the cutter 50. The cutter 50 comprises a fixed blade 50A and a circular blade 50B, similarly to the cutter 24.

FIG. 3 is a block diagram showing the control system of the inkjet recording apparatus 1.

The system controller 64 is a control unit which controls the respective units of the inkjet recording apparatus 1. The system controller 64 is made up of a central processing unit (CPU) and peripheral circuits thereof, and as well as controlling communications with the host computer 60 and controlling reading from and writing to the memory 68, and the like, it generates control signals for controlling the motors 72 and the heaters 76.

The program storage unit 66 is a storage area in which control programs of various types are stored. For this program storage unit 66, it is possible to use, for example, a semiconductor memory such as a ROM or EEPROM, or a magnetic medium, such as a hard disk.

The memory 68 is a storage apparatus which includes a storage area for data of various types and a work area for the system controller 64 to carry out calculations. For this memory 68, it is possible to use, for example, a semiconductor memory such as a RAM, or a magnetic medium, such as a hard disk.

The communications interface 62 is an interface for providing a communications connection with the host computer 60. For the communications interface 62, it is possible to employ a serial interface, such as USB, IEEE 1394, or the like, a parallel interface such as Centronics, a wireless network, or an Ethernet (registered trademark). The image data input via the communications interface 62 is stored temporarily in the memory 68.

The print controller 78 generates a print control signal (dot data) by applying prescribed signal processing to the image data stored temporarily in the memory 68, in accordance with a control signal input from the system controller 64. The print controller 78 controls the head driver 82 on the basis of the print control signal, and thereby controls the ink ejection volume and ejection timing of the ink ejected from the liquid ejection heads 12K, 12C, 12M and 12Y of the print unit 10. Furthermore, the print controller 78 corrects the print control signal on the basis of the ink droplet ejection results obtained from the print determination unit 34. By this means, prescribed dot size and dot positions can be achieved.

The buffer memory 80 is a storage apparatus including a work area for the print controller 78 when processing the image data.

The head driver 82 generates drive signals for driving the print unit 10 (the respective liquid ejection heads 12K, 12C, 12M and 12Y) on the basis of the dot data input from the print controller 78, and supplies these drive signals to the respective liquid ejection heads 12K, 12C, 12M and 12Y.

The motor driver 70 drives the motor 72 in accordance with a control signal input from the system controller 64, and the drive force is transmitted to the rollers 28 and 30 of the suction belt conveyance unit 26 and the conveyance of the recording paper 16 is thereby controller.

The heater driver 74 controls heating by the heater 76 (heating devices of various types including a decurling unit 20, a heating unit 40, a post drying unit 42 and a heating and pressurizing unit 46, and the like) in accordance with control signals input from the system controller 64.

First Embodiment

Next, the liquid ejection head 12 relating to a first embodiment of the present invention will be described. (a) and (b) of FIGS. 4 and 5 are diagrams showing a liquid ejection head according to a first embodiment of the present invention. (a) of FIG. 4 and (a) of FIG. 5 are plan diagrams showing the upper surface of a liquid ejection head, and (b) of FIG. 4 and (b) of FIG. 5 are cross-sectional diagrams of a liquid ejection head.

As shown in (b) of FIG. 4, the liquid ejection head 12 according to the present embodiment comprises a flow channel unit 120 in which a pressure chamber 106 is formed, and a plasma etching apparatus 118 which applies pressure to the liquid (ink) inside the pressure chamber 106 by changing the volume of the pressure chamber 106.

The flow channel unit 120 is composed by laminating and bonding together a pressure chamber plate 102, a spacer plate 122, a manifold plate 124 and a nozzle plate 126. As the material of the pressure chamber plate 102, the spacer plate 122 and the manifold plate 124, it is possible to use, for example, a silicon material, such as silicon (Si), silicon oxide ($SiO_2$), silicon nitride (SiN), quartz glass, or the like, or a metal material, such as stainless steel. Furthermore, as the material of the nozzle plate 126, it is possible to use a resin material such as polyimide, a metal material such as stainless steel, or silicon, for instance.

A plurality of pressure chambers (pressure chamber holes) 106 are formed in the pressure chamber plate 102. The pressure chamber 106 has a substantially oval shape which has a long axis in the main scanning direction in plan view (a substantially elliptical shape). The size of the pressure chamber 106 (length of the lengthwise direction) is 300 μm in diameter, for example. The shape of the pressure chamber 106 may be a shape other than an oval shape (for example, a perfect circle, a square shape, a polygonal shape).

As shown in (a) of FIG. 4, connecting holes 128 and 134 are formed respectively in the spacer plate 122 in positions which overlap with the respective end portions, in the lengthwise direction, of each of the pressure chambers 106. Furthermore, a connecting hole 130 and a common flow channel 136 are formed in the manifold plate 124. The common flow channel 136 is connected to the connection hole 134 of the spacer plate 122. The connecting hole 130 of the manifold plate 124 has the same shape as the connecting hole 128 in the spacer plate 122, and is formed in a mutually overlapping position in planar view.

A nozzle 132 is formed in the nozzle plate 126 at a position which overlaps with the connecting holes 128 and 130. A plurality of nozzles 132 are provided in a two-dimensional arrangement (matrix configuration) in the ejection face (nozzle surface) of the liquid ejection head 12. The nozzles 132 are formed, for example, by excimer laser processing of the nozzle plate 126.

As shown in (a) and (b) FIG. 4, the common flow channel 136 connects to the pressure chamber 106 via the connection hole 134, and the pressure chamber 106 connects to the nozzle 132 via the connection holes 128 and 130. By this means, ink is supplied from the ink storing and loading unit 14 to the pressure chamber 106 via the common flow channel 136, and an ink flow channel for guiding this ink to the nozzle 132 via the pressure chamber 106 is formed.

Next, the piezoelectric actuator 118 will be described. The piezoelectric actuator 118 comprises a lower electrode 108 formed on the diaphragm 104 which forms a wall surface of the pressure chamber 106, a piezoelectric layer 110, and an upper electrode 114 formed on the piezoelectric layer 110, and has a structure in which the lower electrode 108 is a common electrode and the upper electrode 114 is an individual electrode (upper address structure).

The diaphragm 104 is an insulating layer (of silicon oxide ($SiO_2$), for example), and the thickness of the diaphragm 104 is 10 μm, for instance. The diaphragm 104 may be formed entirely as an insulating layer, or an insulating layer may be formed only on the surface of the diaphragm 104.

The piezoelectric layer 110 is a layer of piezoelectric material (for example, lead zirconate titanate (PZT; $Pb(Zr,Ti)O_3$) or barium titanate ($BaTiO_3$)) and is formed by sputtering onto the surface of the diaphragm 104. The thickness of the piezoelectric layer 110 is 3 μm to 4 μm, for example.

As shown in (a) of FIG. 4 and (a) of FIG. 5, the upper electrode 114 is formed in a ring shape surrounding the central portion of the pressure chamber 106 and is formed so as to overlap the insulating portion (the region in the vicinity of the pressure chamber plate 102 (pressure chamber partitions)) which is the non-central part of the pressure chamber 106.

The upper electrode 114 is connected to an external wire (for example, a flexible cable) which is not illustrated. A voltage is applied to the upper electrode 114 from the head driver 82, via this external wire. The lower electrode 108 is earthed at a position which is not depicted in the drawings.

In the present embodiment, the shape of the upper electrode 114 is an oval shape, but another shape (for example, a polygonal shape) may also be adopted. Furthermore, the outline of the inner circumferential portion of the upper electrode 114 and the outline of the outer circumferential portion thereof are similar shapes, but they may also be mutually different shapes.

Desirably, the planar shape of the pressure chamber 106 is substantially similar to the inner circumferential shape of the upper electrode 114, and the pressure chamber 106 and the upper electrode 114 are arranged so as to share the same center position. By this means, an electric field acts in a substantially uniform manner on the region of the piezoelectric layer 110 in the central portion of the pressure chamber 106, and a pressure can be applied in a substantially uniform manner to the pressure chamber 106.

In the examples shown in (b) of FIG. 4 and (b) of FIG. 5, the piezoelectric layer 110 is formed so as to overlap with the pressure chamber plate 102 (pressure chamber partitions) in the outer circumferential portion of the pressure chamber 106. Furthermore, the piezoelectric layer 110 and the upper electrode 114 are arranged in such a manner that the marginal portions on the side of the central portion of the pressure chamber 106 overlap in planar view. The width $D_3$ of the upper electrode 114 in the radial direction is 60 μm, for example, the width $D_4$ of the portion of the upper electrode 114 which overlaps with the pressure chamber plate 102 is 50 μm, for example, and the width dimension $D_5$ which overlaps with the pressure chamber plate 102 is 10 μm, for example. By this means, it is possible to increase the surface area of the active part of the piezoelectric layer 110 which is displaced by the electric field produced between the upper electrode 114 and the lower electrode 108, and the amount of displacement of the diaphragm 104 can be increased.

As shown in (b) of FIG. 4 and (b) of FIG. 5, an opening section (reference numeral 110H in FIGS. 8A to 8F) is formed in the central portion of the piezoelectric layer 110 (the region which overlaps with the central portion of the pressure chamber 106). The diameter of the opening section 110H is 10 μm, for example.

A central electrode 116 is formed in the central portion of the piezoelectric layer 110. The central electrode 116 is formed so as not to make contact with the interior of the ring-shaped upper electrode 114. The diameter $D_1$ of the central electrode 116 is 140 μm, for example, and the distance $D_2$ between the central electrode 116 and the inner circumferential portion of the upper electrode 114 (the marginal portion on the side of the central portion of the pressure chamber 106) is 30 μm, for example.

A central electrode 116 is connected electrically to the lower electrode 108, via an opening section 110H in the piezoelectric layer 110, and is earthed via the lower electrode 108.

FIGS. 6A and 6B are cross-sectional diagrams showing a schematic view of the state of displacement of the piezoelectric layer 110.

As shown in FIG. 6A, the piezoelectric layer 110 is polarized in the direction of the arrow A10, by the lower electrode 108 and the upper electrode 114. Furthermore, the piezoelectric layer 110 is polarized in the direction of arrow A12 by the central electrode 116 and the upper electrode 114.

When a voltage is applied to the upper electrode 114, an electric field is produced in the direction of arrow A10, and furthermore an electric field is produced in the direction of the arrow A12. Due to this action of the electric field, the piezoelectric layer 110 is displaced in the directions of arrows A20 and A22, the diaphragm 104 is deformed convexly in the diagram (FIG. 6B), and ink is introduced into the pressure chamber 106.

Next, the application of voltage to the upper electrode 114 is halted and when the potential of the upper electrode 114 is 0 (V), the diaphragm 104 is returned to the state in FIG. 6A. By this means, ink is ejected from the nozzle 132.

In the present embodiment, distortion is generated in the vertical direction (vertical displacement) as indicated by the arrow A22 between the upper electrode 114 and the central electrode 116, in addition to the normal displacement direction A20, and therefore the amount of flexing displacement of the diaphragm 104 in the upward direction in FIGS. 6A and 6B can be increased.

Here, the distance $D_2$ between the upper electrode 114 and the central electrode 116 is desirably equal to or greater than at least the thickness of the piezoelectric layer 110, so as to prevent shorting between the electrodes. However, it is desirable that the distance $D_2$ between the upper electrode 114 and the central electrode 116 should be designed to suitable dimensions for guaranteeing the rigidity of the piezoelectric layer 110.

Next, the planar shape of the central electrode 116 will be described. FIGS. 7A to 7F are plan diagrams showing examples of the planar shape of the central electrode 116.

Figure 7A:
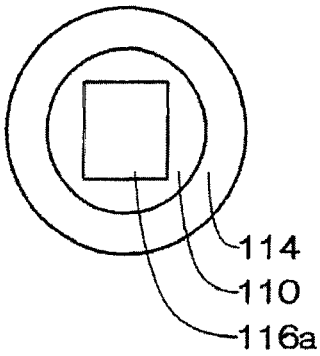
Figure 7B:
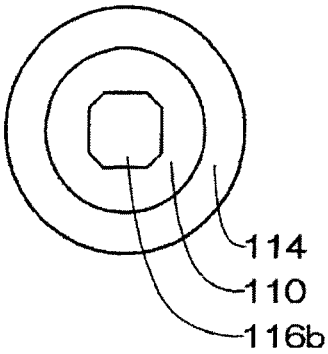
Figure 7C:
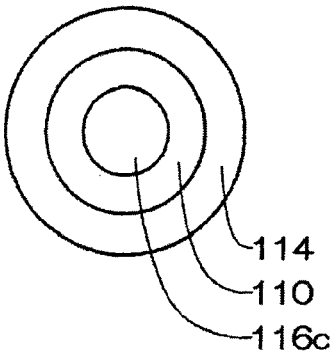

As shown in FIG. 7A to FIG. 7C, if the inner circumferential portion of the upper electrode 114 has an oval shape, then an octagonal central electrode 116*b* as shown in FIG. 7B is desirable due to being closer to the shape of the inner circumferential portion of the upper electrode 114, than the central electrode 116*a* having a square shape shown in FIG. 7A. Moreover, a central electrode 116*c* having an oval shape shown in FIG. 7C is even more desirable, due to being even closer to the inner circumferential portion of the upper electrode 114.

Figure 7D:
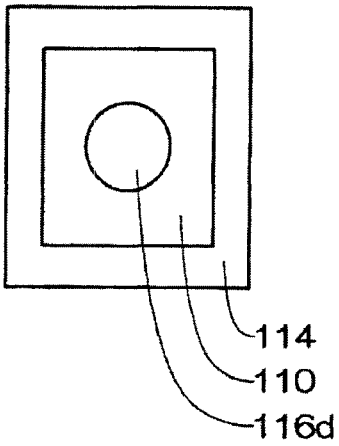
Figure 7E:
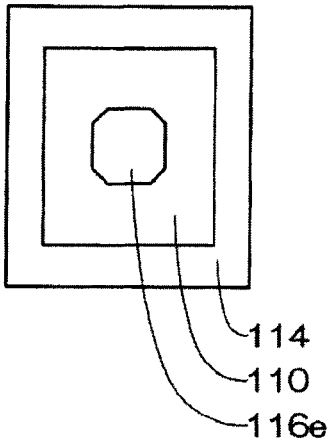
Figure 7F:
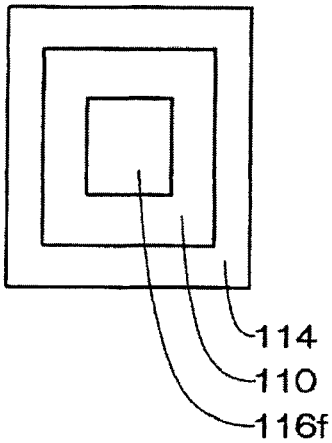

Furthermore, as shown in FIG. 7D to FIG. 7F, if the inner circumferential portion of the upper electrode 114 has a square shape, then an octagonal central electrode 116*e* as shown in FIG. 7E is desirable due to being closer to the shape of the inner circumferential portion of the upper electrode 114, than the central electrode 116*d* having an oval shape shown in FIG. 7D. Moreover, a central electrode 116*f* having an square shape as shown in FIG. 7F is even more desirable, due to being even closer to the inner circumferential portion of the upper electrode 114.

As described above, in order that an electric field is caused to act in a substantially uniform fashion in the region of the piezoelectric layer 110 on the side of the central portion of the pressure chamber 106 and a pressure is applied in a substantially uniform fashion to the pressure chamber 106, desirably, the planar shape of the central electrode 116 is a shape (geometry similar figure) similar to the inner circumferential portion of the upper electrode 114 and the upper electrode 114 and the central electrode 116 are arranged in such a manner that their respective center positions substantially coincide in planar view. Furthermore, desirably, the connecting portion between the central electrode 116 and the lower electrode 108 (the hole 110H in the piezoelectric layer 110) also coincides with the centers of the upper electrode 114, the central electrode 116 and the pressure chamber 106.

According to the present embodiment, by providing a central electrode 116 in the central portion of the upper electrode 114 and disposing same via the lower electrode 108, no potential difference occurs between the lower electrode 108 and the central electrode 116. By this means, it is possible to constrict the distortion which occurs in the central portion of the piezoelectric layer 110, and therefore the rigidity of the diaphragm 104 can be raised. Furthermore, according to the present embodiment, since distortion in the vertical direction (vertical displacement) indicated by arrow A22 in FIG. 6A is produced in the piezoelectric layer 110 between the upper electrode 114 and the central electrode 116, then it is possible to increase the amount of twisting displacement of the diaphragm 104 in the upward direction in FIGS. 6A and 6B. Consequently, according to the present embodiment, it is possible to ensure the rigidity of the diaphragm 104 in the central portion of the pressure chamber 106, at the same time as increasing the amount of displacement.

It is also possible to connect the lower electrode 108 and the central electrode 116 by means of wiring, but in the present embodiment space for forming wires is not required.

Method of Manufacturing Liquid Ejection Head According to First Embodiment

Next, the method of manufacturing a liquid ejection head relating to a first embodiment of the present invention will be described. FIGS. 8A to 8F are cross-sectional diagrams showing a method of manufacturing a liquid ejection head according to a first embodiment of the present invention.

Figure 8A:
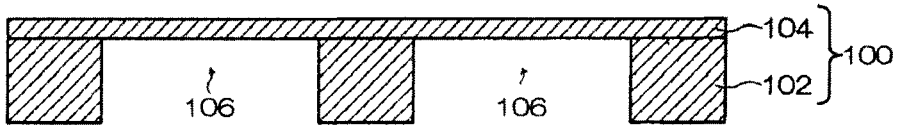

Firstly, a substrate structure body 100 comprising a pressure chamber plate 102 comprising a silicon substrate (Si substrate) having a pressure chamber 106 and a diaphragm 104 which constitutes one wall of pressure chambers 106 is created (FIG. 8A). Here, the dimension of the pressure chambers 106 is, for example, 300 μm in diameter.

Figure 8B:
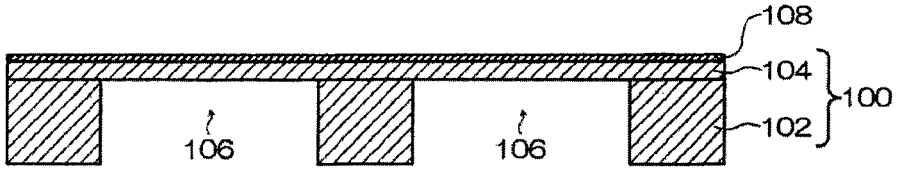

Next, a lower electrode 108 is formed on the surface of the diaphragm 104 (FIG. 8B). The material of the lower electrode 108 is, for example, Ir, Pt, Ti, Ti—Ir, TiW—Ir, Ti—Pt or TiW—Pt. The method of forming the lower electrode 108 is sputtering, vapor deposition or CVD. The thickness of the lower electrode 108 is 100 to 300 nm, for example.

Figure 8C:
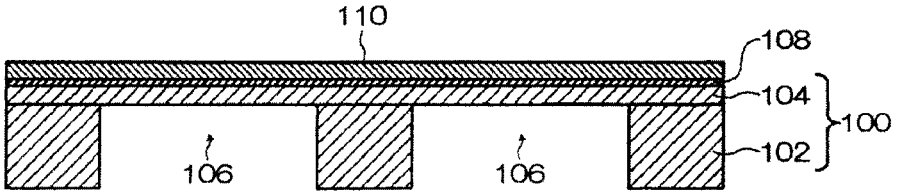

Thereupon, a piezoelectric layer 110 is formed by sputtering on the surface of the lower electrode 108 (FIG. 8C). More specifically, for example, the material of the piezoelectric layer 110 may be lead zirconate titanate (PZT; Pb (Zr, Ti)$O_3$), barium titanate ($BaTiO_3$), or the like. The thickness of the piezoelectric layer 110 is 3 μm to 4 μm, for example.

Figure 8D:
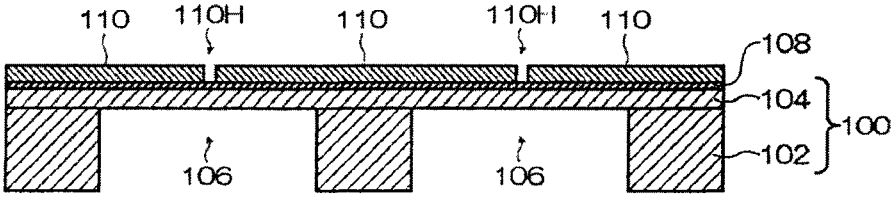

Thereupon, holes 110H are formed at positions corresponding to the central portions of the pressure chambers 106 in the piezoelectric layer 110 (FIG. 8D). In the step in FIG. 8D, the piezoelectric layer 110 is patterned by dry etching (RIE) using fluorine gas or chlorine gas, with an organic film or metal film as a mask. Here, the diameter of the holes 110H is 10 μm or less, for example. Furthermore, after the piezoelectric layer 110 has been formed, the piezoelectric layer 110 is annealed at a prescribed heating temperature (annealing temperature) in an oxygen atmosphere.

Figure 8E:
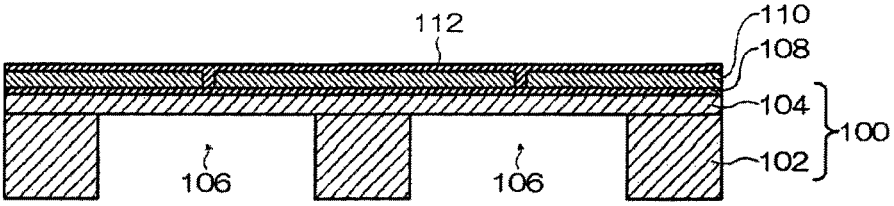

Thereupon, a piezoelectric film 112 is formed on the surface of the piezoelectric layer 110 (FIG. 8E). Here, the material of the electrode film 112 is a material such as TiW—Au, Ti—Au, TiW—Cu or Ti—Cu, for instance. Furthermore, the thickness of the electrode film 112 is 100 to 300 nm, for example. In the step shown in FIG. 8E, an electrode film 112 is formed inside the holes 110H in the piezoelectric layer 110, thereby electrically connecting the lower electrode 108 and the electrode film 112.

Figure 8F:
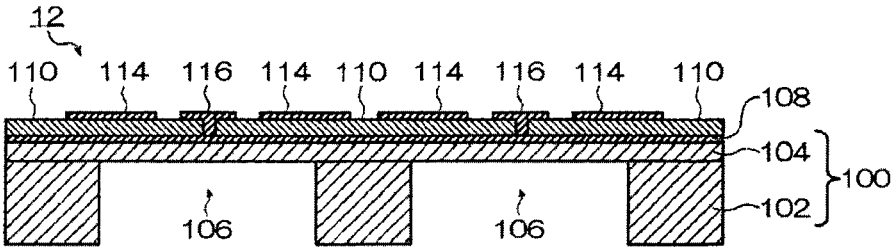

Next, the electrode film 112 is etched (by dry etching or wet etching) to form ring-shaped upper electrodes 114 and central electrodes 116 (FIG. 8F). In the step shown in FIG. 8F, for example, the piezoelectric film 112 is patterned by dry etching (RIE) or wet etching using a fluorine gas or chlorine gas, and employing an organic film or metal film as a mask.

Next, a spacer plate 122, a manifold plate 124 and a nozzle plate 126 are attached to the lower surface (in the diagram) of the pressure chamber plate 102, thereby completing the liquid ejection head 12.

Second Embodiment

Next, a second embodiment of the present invention will be described. In the following description, parts of the composition which are similar to the first embodiment described above are omitted from the explanation.

In the present embodiment, the dimension of the holes 110H formed in the piezoelectric layer 110 is substantially equal to the dimension of the central electrodes 116.

Figure 9A:
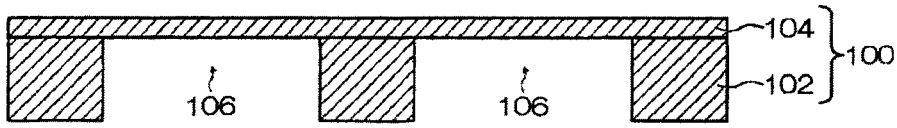
Figure 9B:
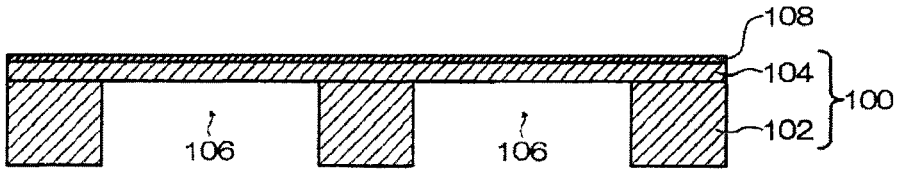
Figure 9C:
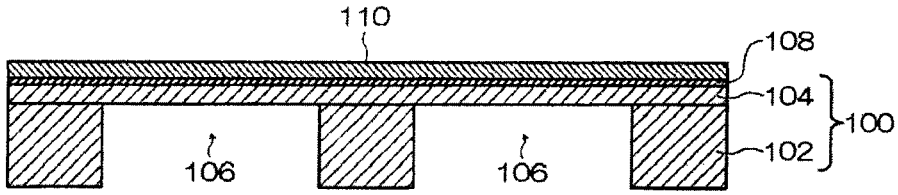

FIGS. 9A to 9G are cross-sectional diagrams showing a method of manufacturing a liquid ejection head according to a second embodiment of the present invention. The steps in FIG. 9A to FIG. 9C are similar to the respective steps in FIG. 8A to FIG. 8C.

Figure 9D:
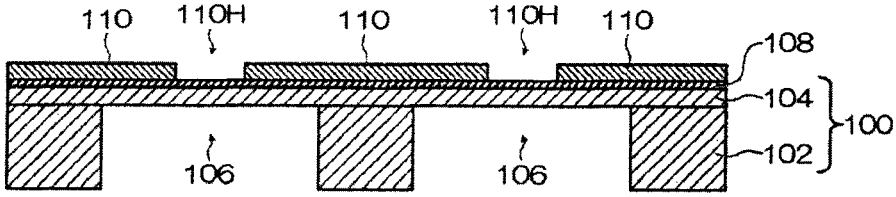

After a piezoelectric layer 110 has been formed in the step in FIG. 9C, holes 110H are formed by dry etching at positions corresponding to the central portions of the pressure chambers 106 in the piezoelectric layer 110 (FIG. 9D). The diameter of the holes 110H is substantially equal to the diameter $D_1$ of the central electrode 116, and is, for example, 140 μm.

Figure 9E:
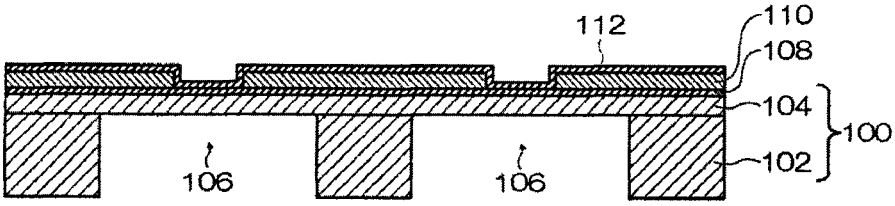

Thereupon, a piezoelectric film 112 is formed on the surface of the piezoelectric layer 110 (FIG. 9E). In the step shown in FIG. 9E, an electrode film 112 is formed inside the holes 110H in the piezoelectric layer 110, thereby electrically connecting the lower electrode 108 and the electrode film 112.

Figure 9F:
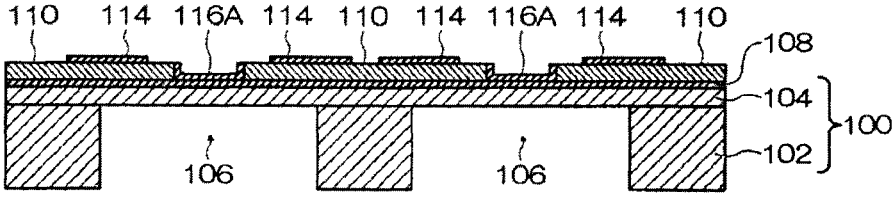

Thereupon, the electrode film 112 is etched (by dry etching or wet etching) to form ring-shaped upper electrodes 114 and electrode films 116A (FIG. 9F).

Figure 9G:
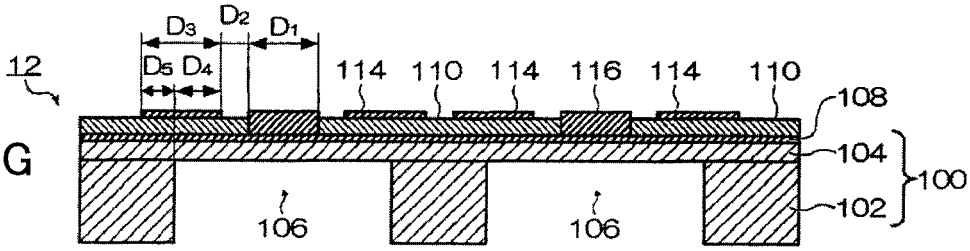

Next, an electric field plating process is carried out on the surface of the electrode film 116A, and a metal film having a Cr—Ni—Cu structure, for example, is laminated onto the surface of the electrode film 116A. By this means, bar-shaped central electrodes 116 which are united with the lower electrode 108 are formed (FIG. 9G). The reference numerals $D_2$ to $D_5$ in FIG. 9G are similar to the first embodiment which was described above.

According to the present embodiment, by forming bar-shaped central electrodes 116, it is possible to increase the rigidity of the diaphragm 104. Furthermore, according to the present embodiment, it is possible to increase the intensity of the electric field produced between the upper electrode 114 and the central electrode 116, and therefore the distortion in the vertical direction indicated by arrow A22 in FIG. 6A (vertical displacement) can be increased and the amount of flexing displacement of the diaphragm 104 can be made yet greater.

In the present embodiment, the central electrode 116 has a bar (column) shape (for example, a circular rod shape or square bar shape), but the central electrode 116 may also be formed with a circular conical or square conical shape which extends upwards from the lower electrode 108 and increases in cross-sectional area in the upward direction.

Third Embodiment

Next, a third embodiment of the present invention will be described. In the following description, parts of the composition which are similar to the first embodiment described above are omitted from the explanation.

In this embodiment, recess portions of substantially equal dimensions to the central electrodes 116 are formed in the piezoelectric layer 110, and the thickness of the central electrodes 116 is increased.

FIGS. 10A to 10H are cross-sectional diagrams showing a method of manufacturing a liquid ejection head according to a third embodiment of the present invention. The steps in FIG. 10A to FIG. 10C are similar to the respective steps in FIG. 8A to FIG. 8C.

After a piezoelectric layer 110 has been formed in the step in FIG. 10C, holes 110$H_1$ are formed by dry etching at positions corresponding to the central portions of the pressure chambers 106 in the piezoelectric layer 110 (FIG. 10D). Here, the diameter of the holes 110$H_1$ is 10 μm or less, for example.

Thereupon, recess sections 110$H_2$ are formed by dry etching on the upper side of the holes 110$H_1$ in terms of the diagram (FIG. 10E). Here, the diameter of the recess sections 110$H_2$ is substantially equal to the diameter $D_1$ of the central electrode 116, and is, for example, 140 μm.

Thereupon, a piezoelectric film 112 is formed on the surface of the piezoelectric layer 110 (FIG. 10F). In the step shown in FIG. 10F, an electrode film 112 is formed inside the holes 110$H_1$ and the recess sections 110$H_2$ in the piezoelectric layer 110, thereby electrically connecting the lower electrode 108 and the electrode film 112.

Thereupon, the electrode film 112 is etched (by dry etching or wet etching) to form ring-shaped upper electrodes 114 and electrode films 116A (FIG. 10G).

Next, an electric field plating process is carried out on the surface of the electrode film 116A, and a metal film having a Cr—Ni—Cu structure, for example, is laminated onto the surface of the electrode film 116A. By this means, central electrodes 116 which are electrically connected to the lower electrode 108 are formed via the holes 110$H_1$ (FIG. 10H). The reference numerals $D_2$ to $D_5$ in FIG. 10H are similar to the first embodiment which was described above.

According to the present embodiment, it is possible to increase the intensity of the electric field produced between the upper electrode 114 and the central electrode 116, and therefore the distortion in the vertical direction indicated by arrow A22 in FIG. 6A (vertical displacement) can be increased and the amount of flexing displacement of the diaphragm 104 can be made yet greater. Moreover, according to the present embodiment, the distortion produced in the central portion of the piezoelectric layer 110 is constricted by the lower electrode 108 and the central electrode 116, and furthermore, the thickness of the central electrode 116 can be increased, and therefore the rigidity of the diaphragm 104 can be raised.

Method of Driving Liquid Ejection Head

In the embodiment described above, since the piezoelectric layer 110 is formed by sputtering, then it is also possible to obtain beneficial effects such as those described below. The direction of polarization of the piezoelectric layer 110 formed by sputtering is opposite to normal, in other words, a direction from the diaphragm 104 toward the upper electrode 114 (the upward direction in (b) of FIG. 4 and so on). Therefore, in order to cause an electric field to act in the same direction as the direction of polarization of the piezoelectric layer 110, if the lower electrode 108 is connected to ground so as to assume a potential of 0 (V), then a drive voltage must be applied in such a manner that the upper electrode 114 becomes a negative potential.

As shown in FIG. 11, in a normal state apart from when an ink ejection operation is carried out, the potential of the upper electrode 114 becomes 0 (V), and the diaphragm 104 does not deform. After starting an ink ejection operation, by changing the potential of the upper electrode 114 from 0 (V) to −V1 (V) (where V1>0), thereby deforming the diaphragm 104 and increasing the volume of the pressure chamber 106, ink is drawn into the pressure chamber 106 from the ink storing and loading unit 14, via the common flow channel 136. When the pressure wave produced inside the pressure chamber 106 switches to positive, the potential of the upper electrode 114 is changed from −V1 (V) to 0 (V), and the diaphragm 104 is returned to its state before deformation. By this means, the ink inside the pressure chamber 106 is pressurized and an ink droplet is ejected from the nozzle 132.

According to the present embodiment, in a normal state when not carrying out an ink ejection operation, a drive voltage is not applied to the upper electrode 114 and no electric field acts on the piezoelectric layer 110. Therefore, it is possible to prevent deterioration of the piezoelectric layer 110. Consequently, the reliability of the liquid ejection head 12 can be raised further.

The present invention can also be applied to liquid ejection heads other than a liquid ejection head which ejects ink as described above (for example, a liquid ejection head for forming a fine wiring pattern on a substrate by ejecting conductive paste, a liquid ejection head for forming a high-definition display by ejecting organic light-emitting material onto a substrate, or a liquid ejection head for forming a fine electronic display such as an optical waveguide, by ejecting optical resin onto a substrate.)

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head, comprising:

a flow channel unit having a plurality of pressure chambers arranged in a plane; and piezoelectric actuators which change volume of the plurality of pressure chambers so as to apply pressure to liquid inside the plurality of the pressure chambers respectively, wherein the piezoelectric actuators comprise:

a diaphragm which constitutes one wall of the plurality of pressure chambers;

a common electrode formed on a surface of the diaphragm;

a piezoelectric layer formed on a surface of the common electrode;

a plurality of ring-shaped individual electrodes formed on a surface of the piezoelectric layer and formed in regions which overlap respectively with marginal portions which are non-central portions of the plurality of pressure chambers, as viewed from a direction perpendicular to the plane; and central electrodes connected electrically to the common electrode, and formed so as not to make contact with the plurality of ring-shaped individual electrodes in inner regions of the plurality of ring-shaped individual electrodes, as viewed from the direction perpendicular to the plane, wherein:

the piezoelectric layer has holes having a smaller planar dimension than the central electrodes and being formed in regions on the surface of the piezoelectric layer which overlap with central portions of the plurality of pressure chambers; and the central electrodes and the common electrode are connected electrically via a metal film formed inside the holes.

2. The liquid ejection head as defined in claim 1, wherein the holes in the piezoelectric layer is formed in centers of inner circumferential portions of the plurality of ring-shaped individual electrodes.

3. The liquid ejection head as defined in claim 1, wherein each of distances between the ring-shaped individual electrode and the central electrodes is equal to or greater than a thickness of the piezoelectric layer.

4. The liquid ejection head as defined in claim 1, wherein the plurality of ring-shaped individual electrodes have an inner circumferential shape that is substantially similar to a planar shape of the central electrodes.

5. The liquid ejection head as defined in claim 4, wherein centers of inner circumferential portions of the plurality of ring-shaped individual electrodes and centers of the central electrodes coincide with each other when observed from the direction perpendicular to the plane.

6. The liquid ejection head as defined in claim 4, wherein the inner circumferential shape of the plurality of ring-shaped individual electrodes is substantially similar to a planar shape of the plurality of pressure chambers.

7. The liquid ejection head as defined in claim 6, wherein centers of the plurality of ring-shaped individual electrodes and centers of the plurality of pressure chambers coincide with each other when observed from the direction perpendicular to the plane.

8. The liquid ejection head as defined in claim 1, wherein the plurality of ring-shaped individual electrodes extend up to regions which overlap with partitions of the plurality of pressure chambers.

9. The liquid ejection head as defined in claim 1, wherein:

the plurality of ring-shaped individual electrodes each have an inner circumference portion in a shape of an oval, and a cross-sectional shape of each of the central electrodes is a square shape.

10. The liquid ejection head as defined in claim 1, wherein:

the plurality of ring-shaped individual electrodes each have an inner circumference portion in a shape of an oval, and a cross-sectional shape of each of the central electrodes is an octagon shape.

11. The liquid ejection head as defined in claim 1, wherein:

the plurality of ring-shaped individual electrodes each have an inner circumference portion in a shape of an oval, and a cross-sectional shape of each of the central electrodes is an oval shape.

12. The liquid ejection head as defined in claim 1, wherein:

the plurality of ring-shaped individual electrodes each have an inner circumference portion in a shape of a square, and a cross-sectional shape of each of the central electrodes is an oval shape.

13. The liquid ejection head as defined in claim 1, wherein:

the plurality of ring-shaped individual electrodes each have an inner circumference portion in a shape of a square, and a cross-sectional shape of each of the central electrodes is an octagon shape.

14. The liquid ejection head as defined in claim 1, wherein:

the plurality of ring-shaped individual electrodes each have an inner circumference portion in a shape of a square, and a cross-sectional shape of each of the central electrodes is an square shape.

15. An image forming apparatus comprising the liquid ejection head as defined in claim 1, wherein the plurality of ring-shaped individual electrodes are arranged on the surface of the piezoelectric layer, on an opposite side to the diaphragm;

the common electrode is earthed; and the piezoelectric layer is polarized in a direction from the diaphragm toward the individual electrodes, the image forming apparatus further comprises a voltage application device which applies drive voltage waveform signals of negative potential to the individual electrodes so as to cause an electric field to act on the piezoelectric layer in a same direction as the direction of polarization of the piezoelectric layer, only when performing an ink ejection operation.

16. A liquid ejection head, comprising:

a flow channel unit having a plurality of pressure chambers arranged in a plane; and piezoelectric actuators which change volume of the plurality of pressure chambers so as to apply pressure to liquid inside the plurality of the pressure chambers respectively, wherein the piezoelectric actuators comprise:

a diaphragm which constitutes one wall of the plurality of pressure chambers;

a common electrode formed on a surface of the diaphragm;

a piezoelectric layer formed on a surface of the common electrode;

a plurality of ring-shaped individual electrodes formed on a surface of the piezoelectric layer and formed in regions which overlap respectively with marginal portions which are non-central portions of the plurality of pressure chambers, as viewed from a direction perpendicular to the plane; and central electrodes connected electrically to the common electrode, and formed so as not to make contact with the plurality of ring-shaped individual electrodes in inner regions of the plurality of ring-shaped individual electrodes, as viewed from the direction perpendicular to the plane, wherein:

the piezoelectric layer has holes having a smaller planar dimension than the central electrodes and being formed in regions which overlap with central portions of the plurality of pressure chambers;

the piezoelectric layer has recess sections having a substantially equal planar dimension to the central electrodes and being formed in regions which overlap with central portions of the plurality of pressure chambers, on the surface of the piezoelectric layer, at positions which overlap with the holes;

the central electrodes are formed in the recess sections; and the central electrodes and the common electrode are connected electrically via a metal film formed inside the holes.

17. The liquid ejection head as defined in claim 16, wherein the holes in the piezoelectric layer is formed in centers of inner circumferential portions of the plurality of ring-shaped individual electrodes.

18. An image forming apparatus comprising the liquid ejection head as defined in claim 16, wherein the plurality of ring-shaped individual electrodes are arranged on the surface of the piezoelectric layer, on an opposite side to the diaphragm;

the common electrode is earthed; and the piezoelectric layer is polarized in a direction from the diaphragm toward the individual electrodes, the image forming apparatus further comprises a voltage application device which applies drive voltage waveform signals of negative potential to the individual electrodes so as to cause an electric field to act on the piezoelectric layer in a same direction as the direction of polarization of the piezoelectric layer, only when performing an ink ejection operation.

* * * * *